United States Patent [19]

Bradley et al.

[11] 4,110,965

[45] Sep. 5, 1978

[54] SPUN-LIKE HAND YARN PROCESS

[75] Inventors: Bruce R. Bradley, Gulf Breeze; Larry D. Eckelman; Donald G. Gilmer, both of Pensacola, all of Fla.

[73] Assignee: Monsanto Company, St. Louis, Mo.

[21] Appl. No.: 752,238

[22] Filed: Dec. 20, 1976

[51] Int. Cl.[2] ..... D02G 1/02; D02G 3/04

[52] U.S. Cl. ..... 57/157 TS; 57/157 S

[58] Field of Search ..... 57/157 TS, 157 S, 2

[56] References Cited

U.S. PATENT DOCUMENTS 3,857,232 12/1974 Heinrich et al. ..... 57/157 TS X 3,857,233 12/1974 Cardinal et al. ..... 57/157 TS X 3,967,441 7/1976 Yasuzuka et al. ..... 57/157 TS X

FOREIGN PATENT DOCUMENTS 971,753 9/1964 United Kingdom ..... 57/157 TS

*Primary Examiner*—Charles Gorenstein

*Attorney, Agent, or Firm*—Kelly O. Corley

[57] ABSTRACT

Yarn comprising filaments of high and low elongations is false-twist heat-set. The yarn tension upon passage through the false twisting device is increased to a level sufficient to break the low elongation filaments, giving a yarn with a spun-like hand.

5 Claims, No Drawings

SPUN-LIKE HAND YARN PROCESS

The invention relates to the art of producing textured yarn, and more particularly to producing such yarn which has a spun-like hand.

Yarns spun from staple fibers have a number of desirable properties, including typically a soft, pleasing hand. However, staple yarns are more expensive than continuous filament yarns, and have lower breaking strengths.

Much interest and effort has been devoted to producing a continuous filament yarn which would simulate a staple yarn. Typical prior patents are U.S. Pat. Nos. 3,137,991 to Fairley and 3,857,233 to Cardinal, which draw-texture yarns comprising filaments of differing properties under tension conditions which break certain of the filaments while in the false-twisted state. As disclosed by Fairley, the resulting broken ends are entangled in the continuous filament core to prevent them from wrapping on the draw roll, and thus cannot protrude from the bundle. The absence of protruding ends would reduce the resemblance to spun yarns. The Cardinal disclosure requires the use of two different polymers, which would require separate facilities and equipment to extrude the two different types of filament.

According to the present invention, these and other disadvantages of the prior art are avoided by the process hereinafter disclosed.

According to a first aspect of the invention, the process comprises providing a feed yarn comprising first filaments having a given elongation and second filaments having a lower elongation, simultaneously drawing and false-twist heat-setting the feed yarn at a draw ratio selected to not break a substantial number of filaments prior to passage through the false-twist device, and increasing the tension on the yarn upon passage through the false-twist device to a tension level sufficient to break the second filaments, whereby the broken ends of the second filaments project outwardly from the yarn and portions of the second filaments intermediate the broken ends are intermingled with the first filaments.

According to another aspect of the invention, the second filaments have a lower denier than the first filaments.

According to another aspect of the invention, the second filaments have a non-round cross section and a ratio of surface to volume at least three times as large as the ratio of surface to volume of the first filaments.

According to another aspect of the invention, there are more of the second filaments than there are of the first filaments.

According to another aspect of the invention, the first and second filaments are formed from the same molten polymer stream.

These and other aspects of the invention are achieved by the following exemplary process.

EXAMPLE

Polyethylene terephthalate polymer of normal textile molecular weight is melted in an extruder and forwarded as a molten stream at a temperature of 290° C to a spinneret. The spinneret has 17 round orifices and 50 non-round orifices of triskelion cross-section as disclosed in U.S. Pat. No. 3,419,936 to Sims, the disclosure of which is incorporated herein by reference. The orifice dimensions and polymer extrusion rate are selected so that, at a winding speed of 3400 yards per minute (about 3100 meters per minute), there is produced a feed yarn having 17 round filaments of 7.9 denier per filament together with 50 triskelion filaments of 2.6 denier per filament, with the small filaments having a lower elongation than the large filaments.

The feed yarn is simultaneously draw-textured at a 1.79 draw ratio on a Barmag FK6 machine at a speed of 350 meters per minute with a heater temperature of 205° C. The false-twisting device is that disclosed in U.S. Pat. No. 3,973,383 to Yu, the disclosure of which is incorporated herein by reference, or may be other known types wherein the tension downstream of the false-twisting device is higher than the tension upstream of the false-twisting device. Under these texturing conditions, there is little if any filament breakage prior to passage through the false-twist device, thus avoiding broken filaments stripping back on the false-twist device. The filament breakage occurs in or after the false-twist device, resulting in a large number of the broken ends protruding outwardly from the textured yarn. The portions of the small filaments intermediate the broken ends are intermingled with the large filaments, preventing stripping back of the broken filaments while leaving the broken ends free.

We claim:

1. A process for making a yarn with a spun-like hand, comprising:
   a. providing a feed yarn comprising first filaments having a given elongation to break and second filaments having a lower elongation to break
   b. simultaneously drawing and false-twist heat-setting said feed yarn at a draw ratio selected to break no substantial number of filaments prior to passage through the false-twist device, and
   c. increasing the tension on said yarn upon passage through said false-twist device to a tension level sufficient to break substantially only said second filaments, whereby the broken ends of said second filaments project outwardly from said yarn and portions of said second filaments intermediate said broken ends are intermingled with said first filaments.

2. The process defined in claim 1, wherein said second filaments have a lower denier than said first filaments.

3. The process defined in claim 1, wherein said second filaments have a non-round cross section and a ratio of surface to volume at least three times as large as the ratio of surface to volume of said first filaments.

4. The process defined in claim 1, wherein there are more of said second filaments than there are of said first filaments.

5. The process defined in claim 1, wherein said first and said second filaments are formed from the same molten polymer stream.

* * * * *